US008977182B2

(12) United States Patent
Nakane et al.

(10) Patent No.: US 8,977,182 B2
(45) Date of Patent: Mar. 10, 2015

(54) LOOP BRUSH ROLLER AND IMAGE FORMING APPARATUS

(75) Inventors: Yoshiki Nakane, Toyokawa (JP); Kuniaki Kashiwakura, Toyohashi (JP); Hokuto Hatano, Hachioji (JP); Yohei Ito, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 174 days.

(21) Appl. No.: 13/524,972

(22) Filed: Jun. 15, 2012

(65) Prior Publication Data

US 2012/0321363 A1 Dec. 20, 2012

(30) Foreign Application Priority Data

Jun. 17, 2011 (JP) ..... 2011-134962

(51) Int. Cl.
*G03G 21/00* (2006.01)

(52) U.S. Cl.
CPC ..... *G03G 21/0035* (2013.01); *G03G 21/0094* (2013.01); *G03G 2221/001* (2013.01)
USPC ..... 399/346

(58) Field of Classification Search
CPC ..... G03G 21/0094; G03G 2221/001
USPC ..... 399/346
See application file for complete search history.

(56) References Cited

U.S. PATENT DOCUMENTS 3,006,383 A * 10/1961 Mahmarian
3,441,063 A * 4/1969 Naimer et al.
3,692,402 A * 9/1972 Solarek
4,404,999 A * 9/1983 Woodall et al.
5,128,725 A * 7/1992 Frankel et al.
5,508,879 A * 4/1996 Kitamura et al.
2005/0079319 A1* 4/2005 Ohara et al.
2011/0164909 A1 7/2011 Nakane et al.
2011/0229232 A1* 9/2011 Kojima et al. ..... 399/346

FOREIGN PATENT DOCUMENTS

| | | | |
|---|---|---|---|
| JP | 63-122371 | | 8/1988 |
| JP | 05-297770 | | 11/1993 |
| JP | 6-289759 | | 10/1994 |
| JP | 08137198 | A * | 5/1996 |
| JP | 11-958 | | 1/1999 |
| JP | 2001-154454 | | 6/2001 |
| JP | 2002-72623 | | 3/2002 |
| JP | 2005-10725 | | 1/2005 |
| JP | 2005-76156 | | 3/2005 |
| JP | 2006-241638 | | 9/2006 |
| JP | 2008-31582 | | 2/2008 |
| JP | 2008-52209 | | 3/2008 |

(Continued)

OTHER PUBLICATIONS

Notice of Grounds of Rejection mailed Oct. 8, 2013, directed to JP Application No. 2011-134962; 6 pages.

(Continued)

*Primary Examiner* — Susan Lee
(74) *Attorney, Agent, or Firm* — Lucas & Mercanti, LLP

(57) ABSTRACT

Fiber bundle forms loops protruding beyond a surface side of a base member with constant spaces therebetween, in at least one of opposite ends located in a direction perpendicular to a weaving direction (W) of a ribbon brush, a weft extending between neighboring loops passes under a warp, and a weft extending through the loop passes above the warp.

13 Claims, 9 Drawing Sheets

(56) References Cited

FOREIGN PATENT DOCUMENTS

| | | |
|---|---|---|
| JP | 2008-79912 | 4/2008 |
| JP | 2009-015033 | 1/2009 |
| JP | 2010-97234 | 4/2010 |
| JP | 2010-107683 | 5/2010 |
| JP | 2011-154280 | 8/2011 |

OTHER PUBLICATIONS

Chinese Office Action, Groups for Rejection, Application No. 201210204971.9, Date of Action: Jun. 5, 2014 (7 pages).
English translation of Chinese Office Action, Groups for Rejection, Application No. 201210204971.9, Date of Action: Jun. 5, 2014 (7 pages).

* cited by examiner

FIG.16

| | | | NUMBER OF PASSED SHEETS | | | |
|---|---|---|---|---|---|---|
| | | | 100k | 400k | 800k | 1200k |
| EXPERIMENTAL EXAMPLE 1 | WARP(S): 2<br>NUMBER OF LOOPS: 12<br>FRAYED END(S): NO | FRAYING | A | A | A | A |
| | | WEARING OF PHOTOSENSITIVE MEMBER | A | A | A | A |
| | | WEARING OF CLEANING BLADE | A | A | A | A |
| | | IMAGE NOISES | A | A | A | A |
| EXPERIMENTAL EXAMPLE 2 | WARP(S): 1<br>NUMBER OF LOOPS: 11<br>FRAYED END(S): UPSTREAM | FRAYING | A | A | A | B |
| | | WEARING OF PHOTOSENSITIVE MEMBER | A | A | A | A |
| | | WEARING OF CLEANING BLADE | A | A | A | A |
| | | IMAGE NOISES | A | A | A | A |
| EXPERIMENTAL EXAMPLE 3 | WARP(S): 1<br>NUMBER OF LOOPS: 11<br>FRAYED END(S): DOWNSTREAM | FRAYING | A | B | C | C |
| | | WEARING OF PHOTOSENSITIVE MEMBER | A | A | B | B |
| | | WEARING OF CLEANING BLADE | A | A | B | C |
| | | IMAGE NOISES | A | A | B | C |
| EXPERIMENTAL EXAMPLE 4 | WARP(S): 2<br>NUMBER OF LOOPS: 12<br>FRAYED END(S): OPPOSITE ENDS | FRAYING | B | C | C | – |
| | | WEARING OF PHOTOSENSITIVE MEMBER | A | B | B | – |
| | | WEARING OF CLEANING BLADE | A | B | C | – |
| | | IMAGE NOISES | A | A | C | – |

LOOP BRUSH ROLLER AND IMAGE FORMING APPARATUS

This application is based on Japanese Patent Application No. 2011-134962 filed with the Japan Patent Office on Jun. 17, 2011, the entire content of which is hereby incorporated by reference.

BACKGROUND OF THE INVENTION

1. Field of the Invention

The present invention relates to a loop brush roller as well as an image forming apparatus such as a copying machine, a printer, a facsimile machine or a combination machine thereof that has a loop brush roller and uses an electrophotographic method.

2. Description of the Related Art

A general image forming apparatus performs image formation, and has a cylindrical and rotatable image carrier, charging means for uniformly charging a surface of the image carrier, exposing means for exposing the image carrier to form an electrostatic latent image, developing means for developing the electrostatic latent image to form a toner image by a potential difference between a voltage applied to a developing unit and the electrostatic latent image, transferring and transporting means that is arranged to face a photosensitive drum for receiving a voltage opposite in polarity to the toner image, thereby transferring the toner image on the image carrier onto a transfer member such as a paper sheer and simultaneously transporting it, cleaning means that is in contact with the photosensitive drum for scraping untransferred residual toner that remains on the photosensitive drum without being transferred onto the transfer member, and fixing means for fixing the toner image onto the transfer member by applying heat and pressure to the toner image transferred onto the transfer member.

As the cleaning means, the apparatus uses a cleaning blade that scrapes the untransferred residual toner by pressing a strip of polyurethane against the image carrier.

In recent years, brush rollers have been used in various positions in the image forming apparatus. As the brush rollers, there have been a loop brush roller in which bundles of fibers extend through a base member formed by weaving warps and wefts together to form loop forms on one of the surfaces, as well as a straight-bristle brush roller having fiber bundles protruding from a base member.

Conventionally, the straight-bristle brush rollers having simple structures have been used in many cases, but use of the loop brush rollers is now spreading because the loop brush roller applies a lower pressure to a contact target and thus applies less damage thereto. A range of use thereof contains an electrically charging brush roller, a cleaning brush roller, a lubricant application brush roller, a paper dust removing brush roller and others. The case where it is used as the loop brush roller for applying the lubricant will be primarily described below.

When the loop brush roller is used, a manner of handling it must be different from that for the straight-bristle brush roller. For example, Japanese Laid-Open Patent Publication No. 2010-107683 (reference 1) has proposed a structure in which an angle formed by rotation directions of a loop brush roller and a brush roller is set in a predetermined fashion to reduce a frictional force between an end of a cleaning blade end and a surface of an image carrier member and thereby to allow a long-term use of the cleaning blade and the image carrier.

Further, Japanese Laid-Open Patent Publication No. 2010-097234 (reference 2) has made such a proposal that an angle of a line of intersection between a flat plane containing a loop and a base member surface is set to a predetermined angle, and thereby uniform scraping of solid lubricant as well as lubricant dropping by shaking it by flicker are achieved.

Japanese Laid-Open Patent Publication No. 06-289759 (reference 3) has disclosed a fur brush roller that is slidably in contact with a surface of an image carrier to clean the surface. This fur brush roller has looped fur members to be in contact with the surface of a latent image carrier, and the looped fur member has a space of at least 3 mm between opposite leg base ends of each member.

However, due to such a structure that the base member into which the loops are woven is spirally wound around a core roller, the loop brush roller suffers from a problem that the loops may fray when they receive a strong tensile force.

When fraying occurs in the loop brush roller that is used as the lubricant applying brush roller, the frayed fiber bundles are wound around the surface of the brush roller so that the leading end portion of the brush roller having a high lubricant-scraping ability is covered with the fiber bundles to lower its lubricant-scraping ability.

This reduces an amount of the lubricant that is supplied to the image carrier from the lubricant-supplying loop brush roller, and increases a friction that occurs between the cleaning blade and the image carrier, and the cleaning blade and the image carrier will become unusable due to wearing within a short term.

SUMMARY OF THE INVENTION

A loop brush roller according to the invention includes a core roller and a ribbon brush spirally wound around the core roller. The ribbon brush includes a base member formed by weaving warps extending in the same direction as a weaving direction and wefts extending perpendicularly to the weaving direction together, and fiber bundles extending in the base member and between the warps in parallel with the warp. Each of the fiber bundles forms loops protruding beyond a surface side of the base member with constant spaces therebetween. In at least one of the opposite ends located in a direction perpendicular to the weaving direction of the ribbon brush, when the surface side is assumed as an upper side, the weft extending between the neighboring loops passes under the warp, and the weft extending through the loop passes above the warp.

The image forming apparatus according to the invention includes an image carrier, and a loop brush roller arranged in rotatable contact with the image carrier, and including core roller and a ribbon brush spirally wound around the core roller, and has a following structure.

The ribbon brush includes a base member formed by weaving warps extending in the same direction as a weaving direction and wefts extending perpendicularly to the weaving direction together, and fiber bundles extending in the base member and between the warps in parallel with the warp. The fiber bundle forms loops protruding beyond a surface side of the base member with constant spaces therebetween. In at least one of the opposite ends located in a direction perpendicular to the weaving direction of the ribbon brush, when the surface side is assumed as an upper side, the weft extending between the neighboring loops passes under the warp, and the weft extending through the loop passes above the warp.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 16 shows a result of evaluation of experimental examples 1 to 5.

DESCRIPTION OF THE PREFERRED EMBODIMENTS

An image forming apparatus in an embodiment according to the invention will be described below with reference to the drawings. Numbers of items, amounts and the like that may be referred to in the following description of the embodiment do not restrict scopes of the invention, unless otherwise specified. Further, the same or corresponding parts and portions bear the same reference numbers, and description thereof may not be repeated (Image Forming Apparatus 100)

Figure 1:
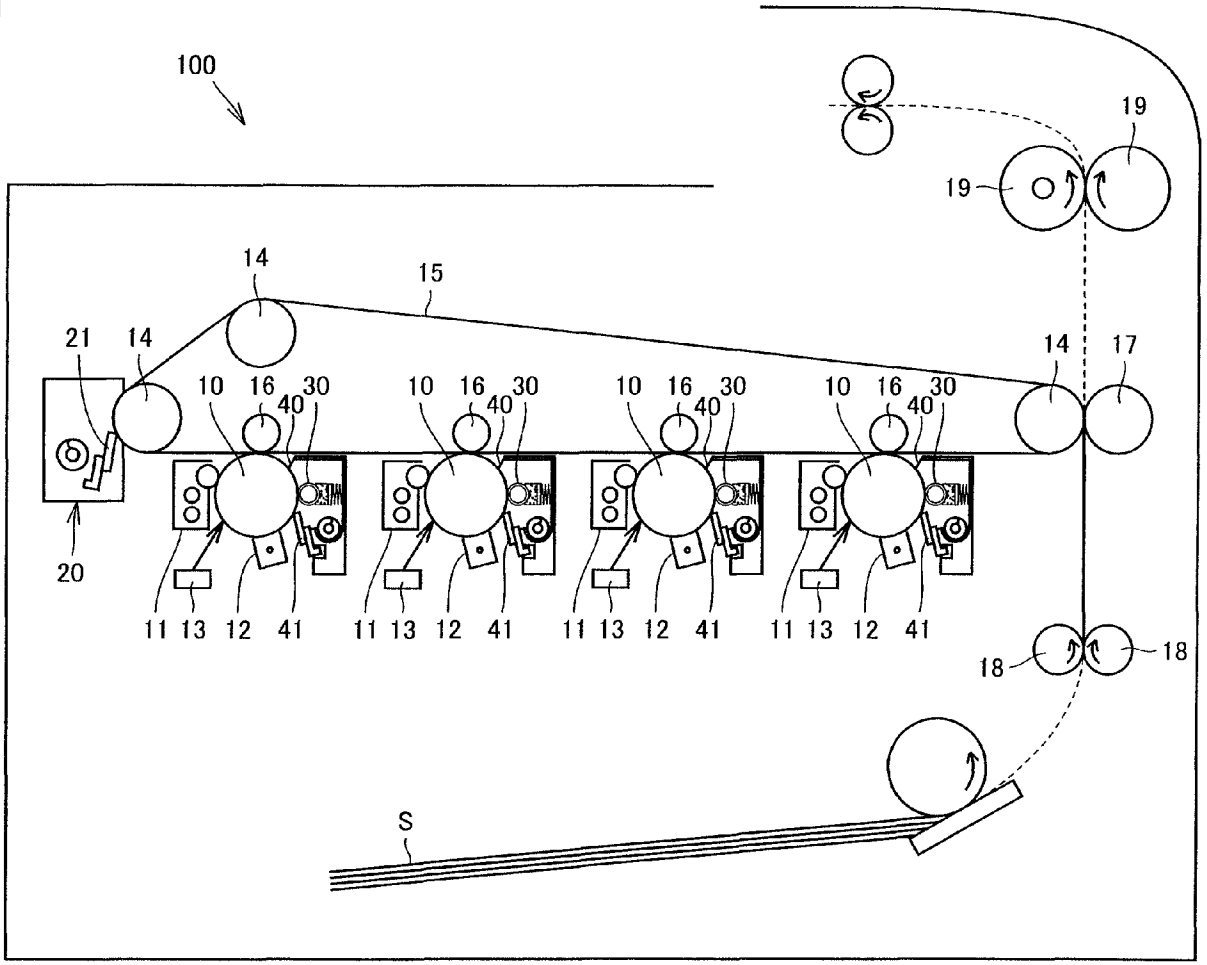
FIG. 1 shows a whole structure of an image forming apparatus in an embodiment.

FIG. 1 shows an image forming apparatus 100 in an embodiment. As shown in FIG. 1, image forming apparatus 100 includes four photosensitive drums 10 that serve as image carriers and correspond to four developing devices containing toner of different colors, i.e., yellow, magenta, cyan and black, respectively.

For performing full-color image formation in image forming apparatus 100, each photosensitive drum 10 rotates to charge a surface of each photosensitive drum 10 by a charging device 12 that performs corona charging. An exposing device 13 performs exposure on each photosensitive drum 10 thus charged according to image data, and thereby forms an electrostatic latent image on the surface of each photosensitive drum 10.

A developing device 11 corresponding to each photosensitive drum 10 bearing the electrostatic latent image performs developing by supplying toner of a predetermined color to the electrostatic latent image on photosensitive drum 10, and thereby forms a toner image of the color on the surface of corresponding photosensitive drum 10.

Primary transfer devices 16 each having a roller-like form successively performs a primary transfer operation of transferring the toner images of the predetermined colors formed on the corresponding photosensitive drums 10 onto an intermediate transfer member 15 of an endless belt form arranged around and driven by rollers 14. Thereby, a full-color toner image is formed on intermediate transfer member 15.

Intermediate transfer member 15 leads the full-color toner image formed on intermediate transfer member 15 to a position opposed to a secondary transfer device 17 of a roller-like form. Simultaneously, a record sheet S accommodated in a lower portion of image forming apparatus 100 is led by feed rollers 18 to a position between intermediate transfer member 15 and secondary transfer device 17, which performs secondary transfer by transferring the full-color toner image thus formed on intermediate transfer member 15 onto record sheet S.

Record sheet S onto which the full-color toner image is transferred is led to a fixing device 19, which fixes the transferred full-color toner image to record sheet S. Thereafter, record sheet S bearing the full-color toner image thus fixed is discharged. Also, the toner that was not transferred onto record sheet S and remains on intermediate transfer member 15 is removed from intermediate transfer member 15 by a first cleaning blade 21 arranged in a first cleaning device 20.

In this image forming apparatus 100, lubricant supplying means 30 supplies the lubricant to the surface of each photosensitive drum 10 as shown in FIG. 1 after the toner image is transferred to intermediate transfer member 15. Thereafter, an edge of a second cleaning blade 40 is pressed against the surface of each photosensitive drum 10 to remove the toner remaining on the surface of each photosensitive drum 10. Also, leveling means 41 applies the lubricant supplied to the surface of each photosensitive drum 10 over the surface of each photosensitive drum 10.

Figure 2:
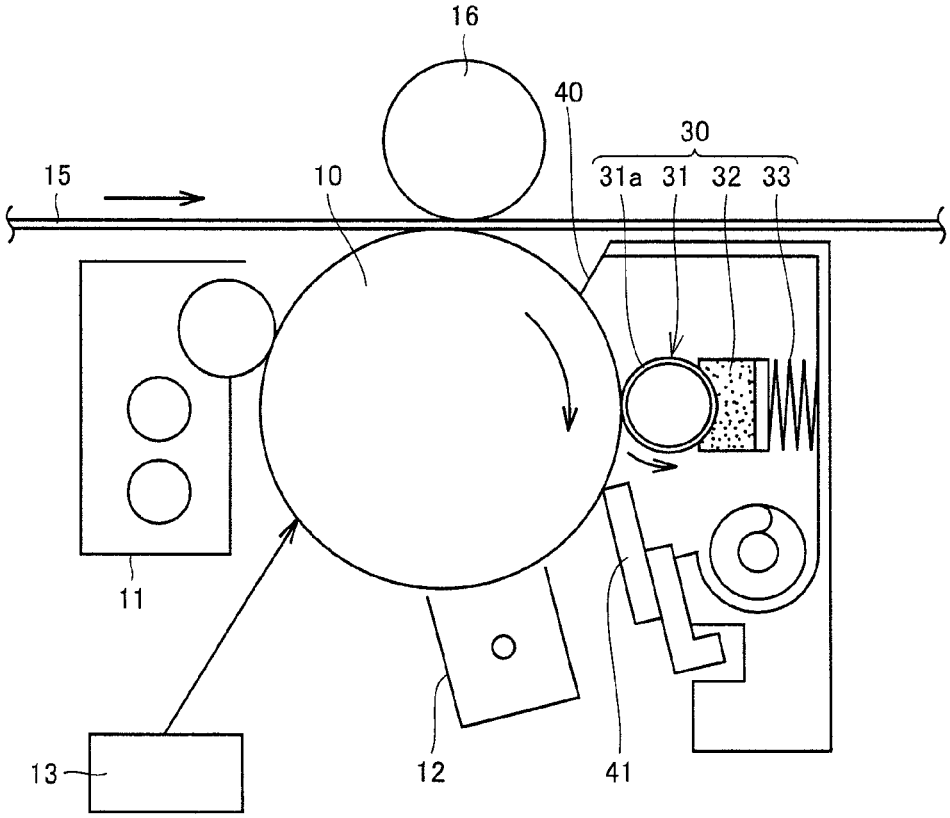
FIG. 2 shows a schematic structure of lubricant supplying means in the embodiment.

As shown in FIG. 2, for supplying the lubricant by lubricant supplying means 30 onto the surface of photosensitive drum 10 after the above transferring, this embodiment employs a loop brush roller 31 that rotates in contact with the surface of photosensitive drum 10 and is arranged in an axial direction of photosensitive drum 10.

Further, pressing means 33 formed of a spring member is configured to press a solid lubricant 32 arranged in the axial direction of photosensitive drum 10 against loop brush roller 31 so that a ribbon brush 31*a* in loop brush roller 31 may scrape the lubricant off solid lubricant 32 to supply it to the surface of photosensitive drum 10.

Loop brush roller 31 performs a counter rotation, i.e., rotation in the same direction as photosensitive drum 10 to attain a linear speed that is substantially equal to or larger (i.e., 1.3 times larger in this embodiment) than that of photosensitive drum 10. It is made of electrically conductive polyester and has a resistance value of $10^6\Omega$-$10^8\Omega$.

It is made of bundles of fibers having a fiber thickness of 4 deniers and a fiber density of 150 kF/inch$^2$. A core roller of loop brush roller 31 is made of iron and has a diameter of 6 mm. Loop brush roller 31 has an outer diameter of 12 mm. The fiber bundles are woven on the base member of 0.5 mm in thickness so that the fiber bundles have a height of about 2.5 mm.

Solid lubricant 32 is formed by melting and forming powder of zinc stearate. If it were used as it is, it would be fragile to break. Therefore, it is adhered to a holding member made of a metal plate by a double-side adhesive tape. Pressing means 33 formed of a compressive spring holds and presses this solid lubricant 32 against loop brush roller 31.

Solid lubricant 32 is shaved to return to a powder form by the rotation of loop brush roller 31 and the pressing force of pressing means 33, and is transferred to a portion, where it comes in contact with photosensitive drum 10 and is applied to photosensitive drum 10. Photosensitive drum 10 is a layered type of organic photosensitive drum having a charge generating layer and a charge transporting layer, and is provided at its outermost surface with an overcoat layer (OCL) of about 2 μm in thickness.

The OCL contains fine particles of $SiO_2$ of 50 nm in particle diameter, and these particles form irregular roughness at the surface of photosensitive drum 10. The irregular forms improve properties of taking in and holding the zinc stearate.

Leveling means 41 that is located downstream, in the rotation direction of photosensitive drum 10, from loop brush roller 31 is made of polyurethane rubber, has a sheet-like form and is arranged in a trailing direction so that its leading end portion may come into contact with photosensitive drum 10.

The powder of solid lubricant 32 that was applied to photosensitive drum 10 by loop brush roller 31 and was transported to the contact portion between leveling means 41 and photosensitive drum 10 forms a film of solid lubricant 32 over photosensitive drum 10. The film of solid lubricant 32 has a low friction coefficient, and can offer an effect of reducing a force that acts between photosensitive drum 10 and second cleaning blade 40 so that it can reduce the friction between photosensitive drum 10 and second cleaning blade 40 to increase a life of photosensitive drum 10.

(Loop Brush Roller 31)

Figure 3:
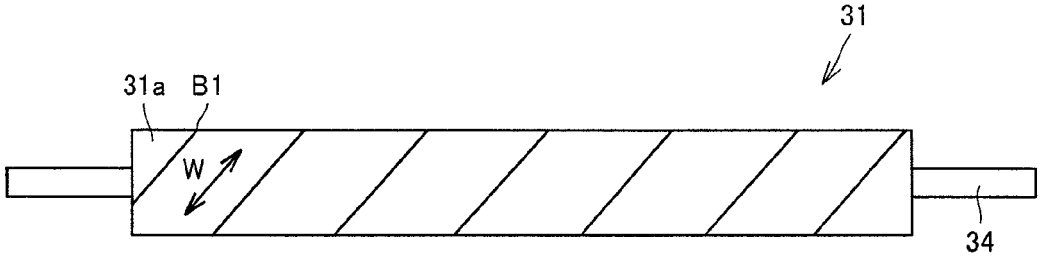
FIG. 3 shows a whole structure of a loop brush roller in the embodiment.

FIG. 3 shows a whole structure of loop brush roller 31 in the embodiment. As shown in FIG. 3, loop brush roller 31 is formed of a core roller 34 made of metal and ribbon brush 31*a* wound around core roller 34. Ribbon brush 31*a* is a ribbon of a strip form having a predetermined width, and is formed by passing the fiber bundles through the base member formed by weaving the warps and wefts together and thereby forming loop forms on one of the surfaces.

A generally used iron shaft is used as core roller 34. It is desirable that core roller 34 has an outer diameter of 6 mm or more from a viewpoint of preventing bending. Since ribbon brush 31*a* is wound around core roller 34, this structure produces a seam B1 where opposite ends of ribbon brush 31*a* are in contact with each other.

(Structure of Ribbon Brush 31*a*)

Figure 4:
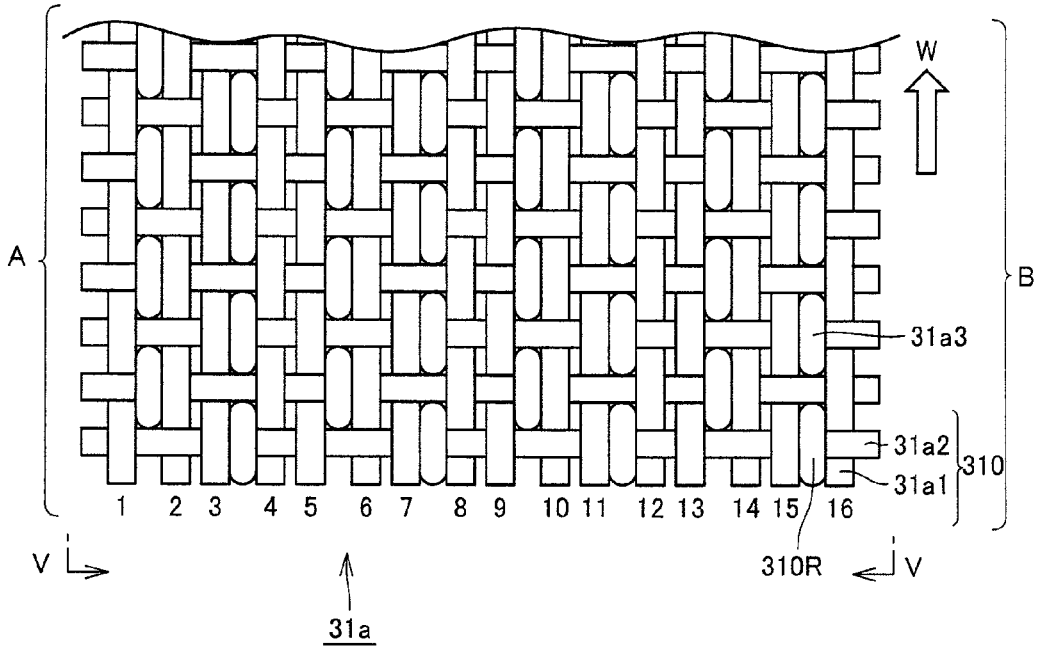
FIG. 4 is a plan of a ribbon brush in the embodiment.
Figure 5:
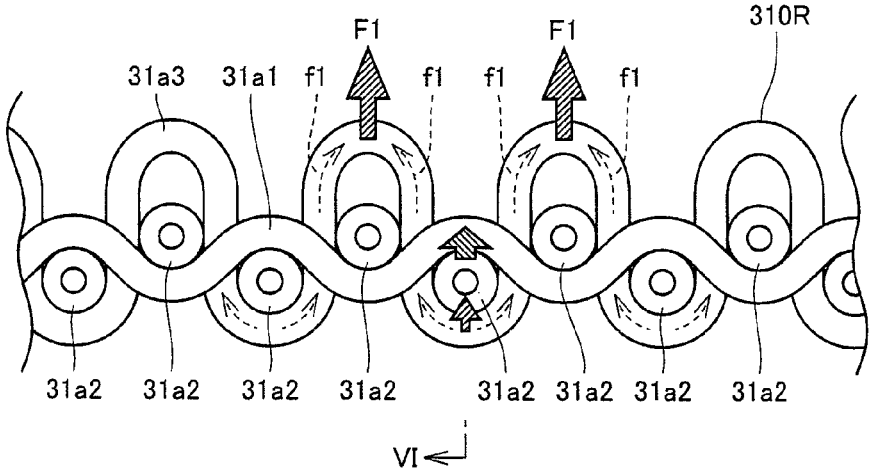
FIG. 5 shows a structure of an end viewed in a direction perpendicular to a weaving direction (W) indicated by V in FIG. 4.

FIG. 4 shows a schematic structure of ribbon brush 31*a* in the embodiment, and FIG. 5 shows a structure of an end portion viewed in a direction perpendicular to a weaving direction (W) indicated by V in FIG. 4. As shown in FIG. 4, ribbon brush 31*a* in the embodiment has a base member 310 that is formed by weaving warps 31*a*1 running in the same direction as the weaving direction (W) and wefts 31*a*2 running perpendicularly to the weaving direction (W) together, and fiber bundles 31*a*3 extending parallel to warp 31*a*1 through base member 310 protrude at regularly spaced positions on the front surface (one of the surfaces) of base member 310 to form loops 310R.

In this embodiment, sixteen warps are used, and fiber bundle 31*a*3 is not arranged between #2 and #3, between #4 and #5, between #6 and #7, between #8 and #9, between #10 and #11, between #12 and #13, and between #14 and #15.

As shown in FIG. 5, in fiber bundle 31*a*3 located in each end portion and extending between #1 and #2 or between #15 and #16, weft 31*a*2 extending between neighboring loops 310R passes under warp 31*a*1 , and weft 31*a*2 extending through loop 310R passes above warp 31*a*1.

Figure 6:
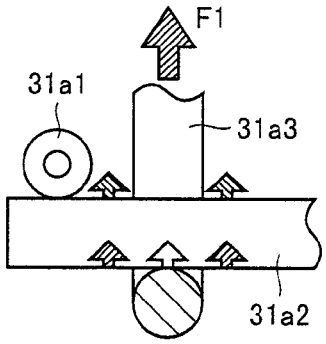
FIG. 6 is a first schematic view showing a case where a tensile force is applied to a loop of the ribbon brush in the embodiment.
Figure 7:
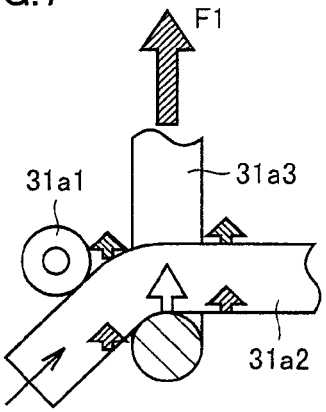
FIG. 7 is a second schematic view showing a case where the tensile force is applied to the loop of the ribbon brush in the embodiment.

Referring to FIGS. 5 to 7, the case where a tensile force F1 acts on loop 310R will be described below. FIGS. 6 and 7 schematically show forces that occur in warp 31*a*1 and weft 31*a*2 when tensile force F1 acts on loop 310R, and correspond to a view taken in a direction of arrow VI in FIG. 5.

As shown in FIG. 6, when tensile force F1 acts on each of neighboring loops 310R, a tension of f1 acts on fiber bundle 31*a*3, and a force acts to pull up weft 31*a*2 located between neighboring loops 310R.

As shown in FIG. 7, however, warp 31*a*1 is present above weft 31*a*2 in a region between neighboring loops 310R, and therefore prevents upward movement of weft 31*a*2. Consequently, in the opposite ends of ribbon brush 31*a* in this embodiment, even when the tensile force acts on loops 310R, fraying at the opposite ends of ribbon brush 31*a* can be suppressed.

Figure 8:
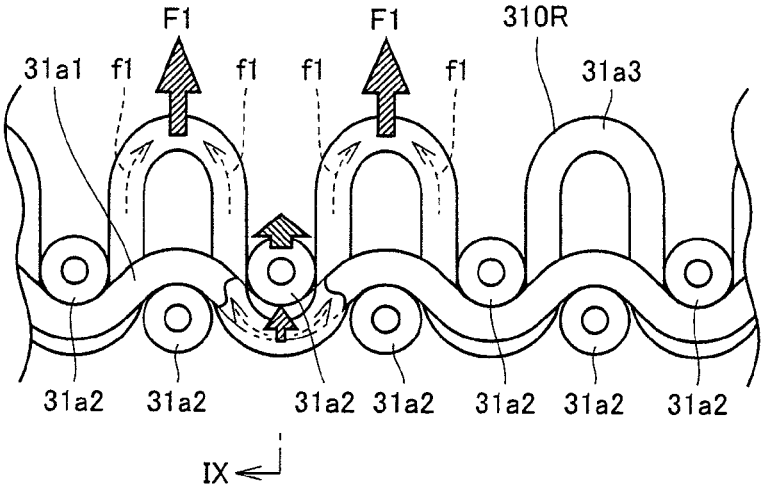
FIG. 8 is a corresponding view showing a structure of an end portion in a comparison example viewed in a direction perpendicular to the weaving direction (W) indicated by V in FIG. 4.
Figure 9:
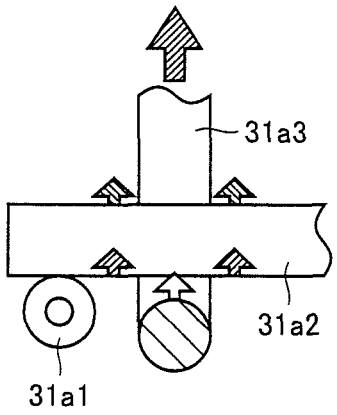
FIG. 9 is a first schematic view showing a case where a tensile force is applied to a loop of a ribbon brush in the comparison example.
Figure 10:
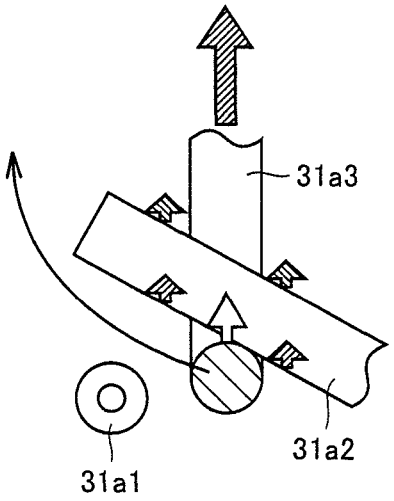
FIG. 10 is a second schematic view showing a case where the tensile force is applied to the loop of the ribbon brush in the comparison example.

Referring to FIGS. 8 to 10, the case where the opposite ends of ribbon brush 31*a* are liable to fray will be described below. FIG. 8 shows a structure corresponding to the end viewed perpendicularly to the weaving direction (W) similarly to FIG. 5. FIGS. 9 and 10 schematically show forces that occur in warp 31*a*1 and weft 31*a*2 when tensile force F1 acts on loop 310R, and correspond to a view taken in a direction of arrow IX in FIG. 8.

In FIG. 8, weft 31*a*2 extending between neighboring loops 310R passes above warp 31*a*1 , and weft 31*a*2 extending through loop 310R passes under warp 31*a*1 . The manner of weaving warps 31*a*1 and wefts 31*a*2 is opposite to that in FIG. 5.

When tensile force F1 acts on each of neighboring loops 310R, the tension of f1 acts on fiber bundle 31*a*3 to act as a force pulling up weft 31*a*2 located between neighboring loops 310R.

Since warp 31*a*1 is present under weft 31*a*2 between neighboring loops 310R as shown in FIG. 9, warp 31*a*1 does not prevent the upward movement of weft 31*a*2. Consequently, warp 31*a*1 can be easily lifted upward to cause fraying at the end of ribbon brush 31*a*.

When the fraying occurs at the end of ribbon brush 31*a*, fluffing is observed at seam B1 (see FIG. 3) in the brush roller. When the brush roller having the frayed portion is continuously used, the frayed portion becomes long and will be wound around the brush roller to cover the surface of the brush roller.

In this state, the frayed fiber bundles 31*a*3 cover the leading end portion of the brush roller that has a large ability of scraping off solid lubricant 32, which reduces the ability of scraping off solid lubricant 32. This causes a failure in film formation of solid lubricant 32 to increase the friction between photosensitive drum 10 and second cleaning blade 40. This results in decrease in life of photosensitive drum 10 so that image noises will occur early.

Figure 11:
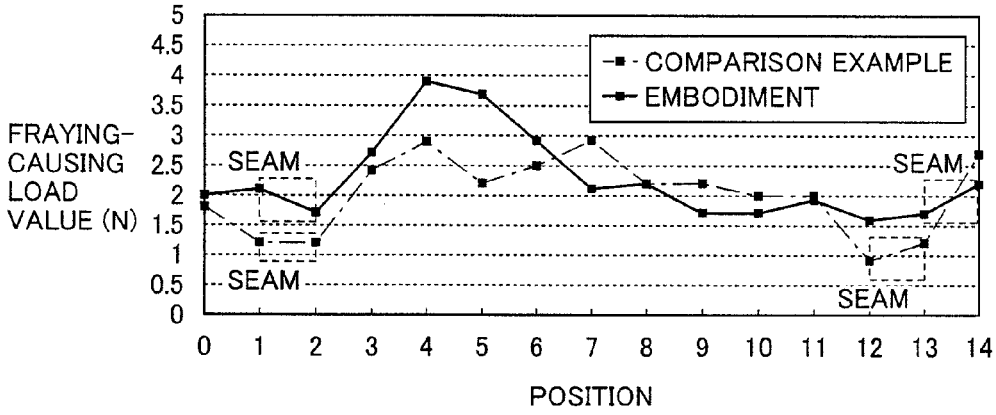
FIG. 11 shows a relationship between a position and a fraying-causing load value of the loop brush roller in the embodiment and the loop brush roller in the comparison example.

For evaluating loop brush roller 31 in this embodiment, the possibility of causing the fraying was evaluated in connection with loop brush roller 31 in the embodiment and the brush roller of the structure shown in FIG. 8. FIG. 11 shows the result of the evaluation.

For the evaluation, such a method was employed that a hook attached to a portion of a measurement probe portion of a push-pull gauge was hooked to the loop of the brush roller and a tensile force was applied thereto to measure a load value causing the fraying. The loop that is liable to cause the fraying causes the fraying even when the load is small, and the loop that is resistant to fraying does not fray until a large load is applied.

The load value which caused the fraying of the loop in the longitudinal direction of the brush roller was measured. Owing to the structure of the brush roller in which the ribbon brush is spirally wound around the core roll, the brush roller in the embodiment differs from the comparison brush roller in load value causing the fraying at the seam where the ribbon brush ends continue.

In the comparison brush roller, the end of the ribbon brush exhibited the fraying-causing load value between 1 N and 1.3 N, and thus was frayed by a tensile force lower than the fraying-causing load value of 1.5 N or more of the other regions.

In the brush roller in the embodiment, the end portion of the ribbon brush exhibited the fraying-causing load value of 1.5 N or more, and it was confirmed that the end potion has substantially the same resistance against the fraying as the regions other than the end.

Referring to FIG. 4 again, description about fiber bundle 31*a*3 forming the loop will be given particularly in connection with a relationship between the number of warps 31*a*1 passing between neighboring fiber bundles 31*a*3, the number of fiber bundles 31*a*3 located on or between one and the other ends of ribbon brush 31*a* and the direction in which ribbon brush 31*a* is wound around core roller 34.

The case where warps 31*a*1 extending between neighboring fiber bundles 31*a*3 are even in number, and fiber bundles 31*a*3 on or between one and the other ends of ribbon brush 31*a* are even in number will be discussed below.

Figure 12:
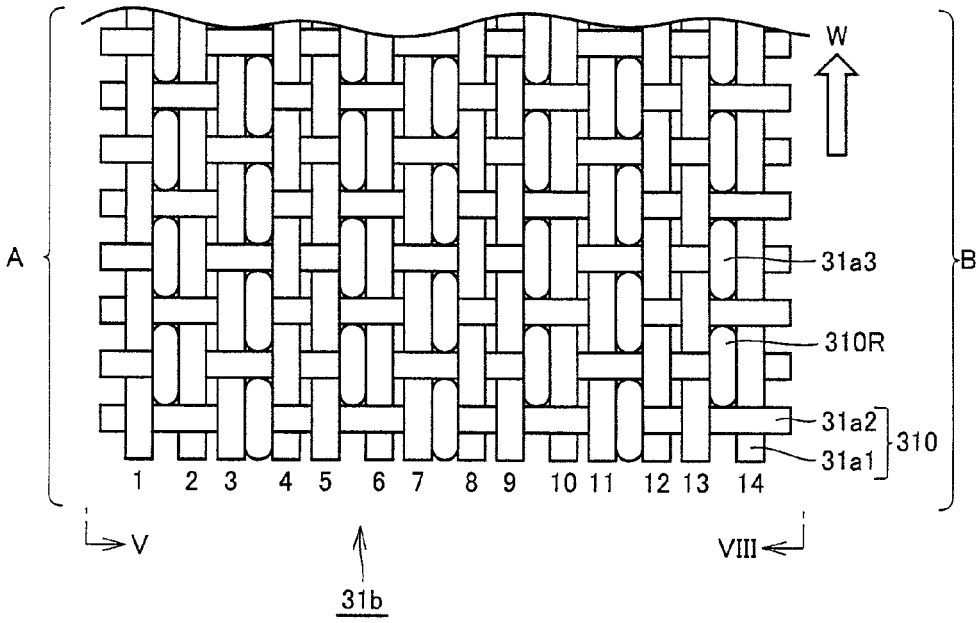
FIG. 12 is a plan of a ribbon brush of another embodiment.

As shown in FIG. 12, when warps 31*a*1 between neighboring fiber bundles 31*a*3 are two in number and fiber bundles 31*a*3 on or between one and the other ends of ribbon brush 31*b* are eight in number, the end to which the embodiment of the invention is applied can be formed in each of ends A and B of ribbon brush 31*b*.

Accordingly, ribbon brush 31*b* of the above structure has a uniform resistance against the fraying regardless of the winding direction of the ribbon around core roller 34, and it is most desirable to use this ribbon brush 31*b* as the structure of the brush roller.

Then, a ribbon brush 31*c* shown in FIG. 13 will be discussed. In ribbon brush 31*c*, when warps 31*a*1 passing between neighboring fiber bundles 31*a*3 are even (e.g., two) in number, and fiber bundles 31*a*3 located on or between the opposite ends are odd (e.g., seven) in number, the end surface to which the embodiment of the invention is applied can be formed on one end (end A), but the other end (end B) has a structure shown in FIG. 8 that is liable to fray.

Figure 13:
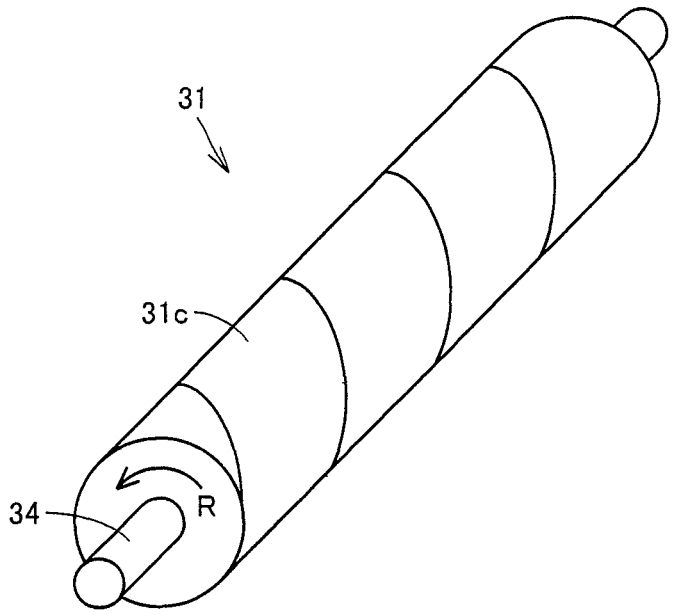
FIG. 13 is a perspective view showing a state in which the ribbon brush is spirally wound around a core roller.
Figure 14:
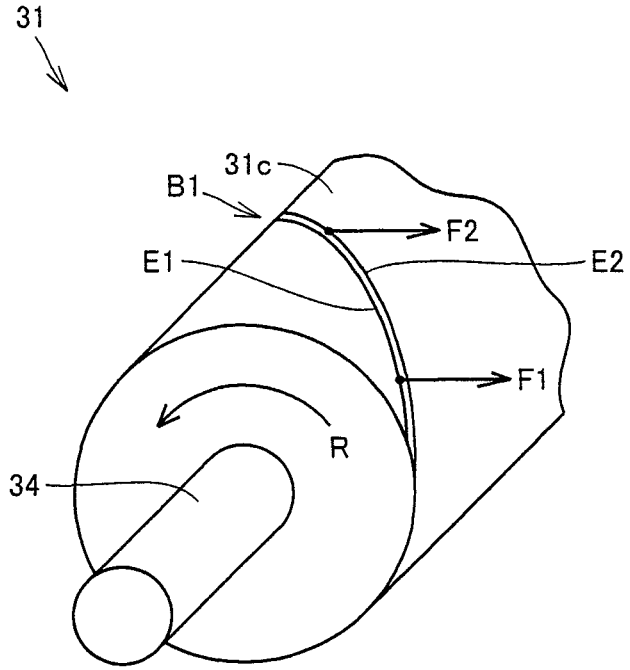
FIG. 14 schematically shows an external force occurring at a seam of the ribbon brush of the loop brush roller.

Accordingly, in the case where ribbon brush 31*c* is to be spirally wound around core roller 34 as shown in FIGS. 13 and 14, it is wound such that an end portion E1 having end A is located downstream (on the rear side in the moving direction of ribbon brush 31*c*) in a rotation direction R of loop brush roller 31. Thereby, an end portion E2 having end B that is liable to fray is located on the upstream side (forward side in the moving direction of ribbon brush 31*c*) in rotation direction R.

Consequently, as shown in FIG. 14, force F1 in the tensile direction acts on end A resistant to the fraying, and a force F2 in the compression direction acts on end B that is liable to fray so that it is possible to suppress occurrence of the fraying at seam B1.

Through FIGS. 4 to 12, the example where warps 31*a*1 passing between neighboring fiber bundles 31*a*3 are two in number has been described. However, the same is true with respect to the cases where the number increases to 4, 6 or others provided it is even.

Likewise, the cases where fiber bundles 31*a*3 on or between the opposite ends of the ribbon brush are four in FIG. 4 or seven in FIG. 12 have been described. However, the fiber bundles may be even or odd in number.

Figure 15:
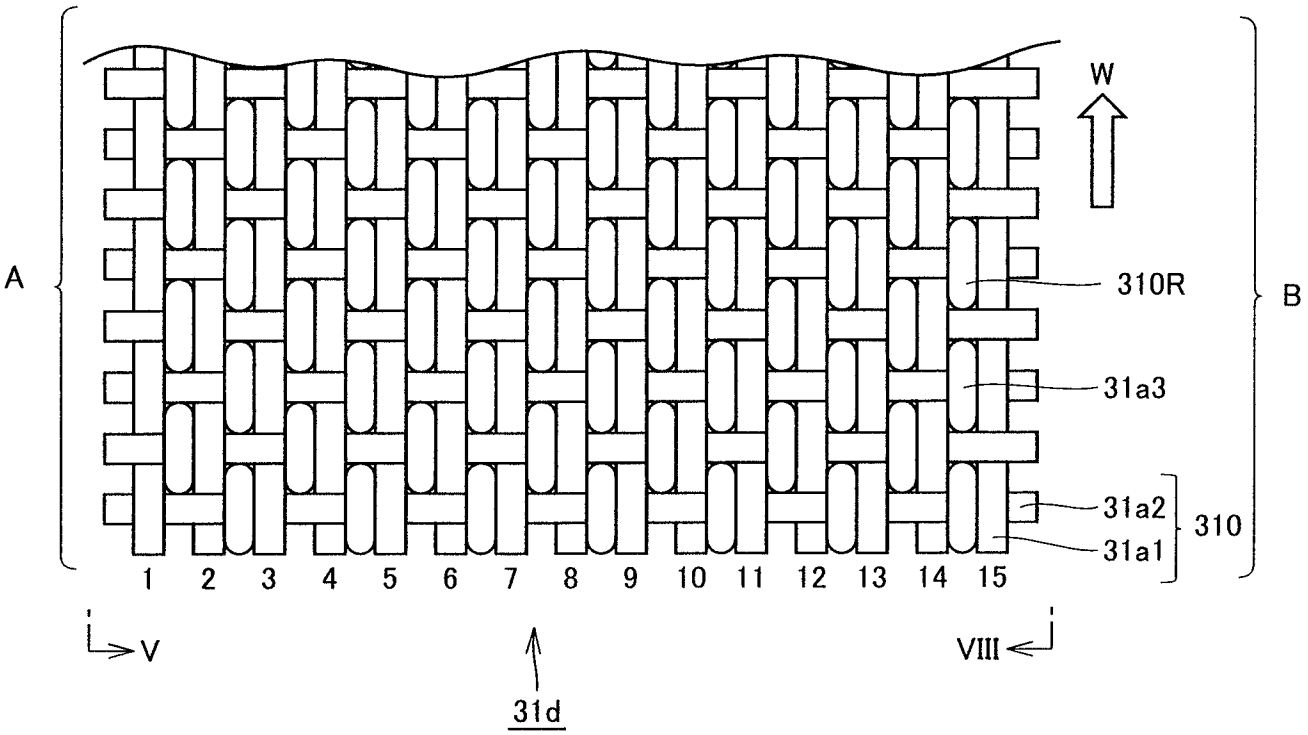
FIG. 15 is a plan showing a ribbon brush of a still another embodiment.

Referring to FIG. 15, a ribbon brush 31*d* in the case where warps 31*a*1 extending between neighboring fiber bundles 31*a*3 is odd (one) in number will be described below. When the end surface employing the embodiment of the invention is applied is formed at end A, end B has the end structure that is liable to fray and is shown in FIG. 8 regardless of the number of the loops located on or between the opposite ends of ribbon brush 31*d*.

Therefore, in the process of spirally winding ribbon brush 31*d* around core roller 34, it is effective to perform the winding such that end A employing the embodiment of the invention is located downstream in the rotation direction of the brush roller. Although it has been described that warp 31*a*1 passing between neighboring fiber bundles 31*a*3 is one in number, the same is true with respect to the cases where the number increases to 3, 5 or others provided it is odd.

Experimental Example

Durability tests were performed on experimental examples 1, 2 and 3 using brush rollers employing the embodiment of the invention as the brush rollers for the lubricant application, as well as an experimental example 4 using a brush roller having the end structures shown in FIG. 8 in opposite ends, respectively.

Machines used in the durability tests were prepared by modifying imaging units "bizhub PRO C6501P" (A4 65 sheets/min, 600 dpi) manufactured by Konica Minolta Business Technologies, Inc. into structures of the experimental examples. The test used lubricant supplying means 30, solid lubricant 32 and photosensitive drum 10 already illustrated in FIGS. 1 and 2.

Pressing means 33 pushed solid lubricant 32 against loop brush roller 31 at 2 N/m. Second cleaning blade 40 was made of polyurethane rubber, and its pressing force and contact angle were 25 N/m and 15 degrees, respectively. The pressing force and the contact angle of leveling means 41 were 25 N/m and 45 degrees, respectively.

Developing device 11 performed two-component developing using developer made of a mixture of carrier and toner, and the toner had a negative charging property. Such endurance conditions were used that charts of colors each having an image density of 5% were continuously printed under an environment of 23 deg. C. and 65% R/H.

An amount of wearing of the film thickness of photosensitive drum 10, a width of a worn portion of second cleaning blade 40 and image noise were determined as evaluation items after passing the sheets of 100 k (k is 1000 (third power of 10)), 400 k, 800 k and 1200 k in number.

FIG. 16 shows results of the determination. In FIG. 16, "A" in "FRAYING" represents "no fraying", "B" represents that the frayed loop had a length equal to or smaller than ((loop height)×2), and "C" represents that the frayed loop had a length larger than ((loop height)×2).

In connection with the amount of wearing of the film thickness of photosensitive drum 10 ("PHOTOSENSITIVE DRUM WEARING"), "A", "B" and "C" represent an amount equal to or smaller than 1.0 μm, an amount smaller than 1.4 μm and an amount equal to or larger than 1.4 μm, respectively.

In "CLEANING BLADE WEARING", "A" represents the width of wearing observed by a microscope that is equal to or smaller than 20 μm, "B" represents the width between 20 μm and 30 μm, and "C" represents the width of 30 μm or more.

In connection with the "IMAGE NOISE", such an A3-size chart in portrait format was prepared that bears a solid belt-like image between positions of 0 mm and 100 mm from an edge thereof and a while solid image between positions of 100 mm and 420 mm. Using this image, evaluation about a cleaning failure and fogging was performed. "A" represents that neither cleaning failure nor fogging occurred. "B" represents that slight fogging occurred and "C" represents that the cleaning failure or serious fogging occurred.

The brush roller used in the above has a structure shown in FIGS. 13 and 14. The experimental example 1 used a ribbon brush provided at its opposite ends with the structures according to the present invention shown in FIGS. 5 to 7. In each of the ribbon brushes used in the experimental examples 2 and 3, one end portion is based on the invention, but the other end portion is the "frayed end" shown in FIGS. 8 to 10. In the experimental example 2, the ribbon brush is wound such that the frayed end may be located on the upstream side in rotation direction R in FIG. 13 (i.e., on the forward side in the moving direction of the ribbon brush). Conversely, in the experimental example 3, the ribbon brush is wound such that the frayed end may be located on the downstream side in rotation direction R (i.e., on the rearward side in the moving direction of the ribbon brush). The experimental example 4 uses a ribbon brush having the "frayed end" at its opposite end portions, respectively.

As described above, in the brush roller in the embodiment and the image forming apparatus using the brush roller, even when the loop in the brush roller receives a tensile force, the warps passing between the loops interfere with the wefts so that fraying of the loops can be suppressed.

Thereby, it is possible to prevent disadvantages caused by fraying of the ribbon brush. For example, when the loop brush is used as the brush roller for lubricant application, it is possible to prevent occurrence of the image noises due to wearing of the cleaning blade and the photosensitive drum within a short period due to reduction in amount of the lubricant applied to the image carrier.

Although the embodiment has been described in connection with the case where the brush roller is used as the brush roller for lubricant application, similar effects can be achieved even in the case where it is used as a charging brush roller, a cleaning brush roller, a paper powder removing brush roller or the like.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A loop brush roller comprising a core roller and a ribbon brush spirally wound around said core roller, wherein said ribbon brush includes:

a base member formed by weaving warps extending in the same direction as a weaving direction and wefts extending perpendicularly to said weaving direction together, and fiber bundles extending in said base member and between said warps in parallel with said warp;

each of said fiber bundles forms loops protruding beyond a surface side of said base member with constant spaces therebetween;

opposite ends of said ribbon brush a direction perpendicular to the weaving direction each has an end fiber bundle and an end warp, the end warp disposed on a side of the end fiber bundle facing a respective one of the opposite ends; and in at least one of the opposite ends, when said surface side is assumed as an upper side, said weft extending between said neighboring ones of said loops of the end fiber bundle pass under said end warp, and the wefts extending through each of the loops of the end fiber bundle pass above said end warp.

2. The loop brush roller according to claim 1, wherein in the each of the opposite ends located in the direction perpendicular to the weaving direction of said ribbon brush, said weft extending between said neighboring ones of loops passes under said end warp, and the weft extending through said loop passes above said warp.

3. The loop brush roller according to claim 2, wherein said warps between said fiber bundles are even in number, and said fiber bundles are even in number.

4. The loop brush roller according to claim 1, wherein said warps between said fiber bundles are even in number, said fiber bundles are odd in number, and said ribbon brush is spirally wound around said core roller such that one end of the opposite ends located in the direction perpendicular to said weaving direction of said ribbon brush, where said weft extending between said neighboring ones of said loops passes under said end warp and the weft extending through said loop passes above said warp, is positioned downstream in the rotation direction of said loop brush roller.

5. The loop brush roller according to claim 1, wherein said warp(s) between said fiber bundles are odd in number, said fiber bundles are odd in number, and said ribbon brush is spirally wound around said core roller such that one end of the opposite ends located in the direction perpendicular to said weaving direction of said ribbon brush, where said weft extending between said neighboring ones of said loops passes under said end warp and the weft extending through said loop pass above said end warp, is positioned downstream in the rotation direction of said loop brush roller.

6. The loop roller according to claim 1, wherein said ribbon brush is spirally wound around said core roller such that one end of the opposite ends located in the direction perpendicular to said weaving direction of said ribbon brush, where said wefts extending between the neighboring ones of said loops pass under said end wrap and the wefts extending through said loops pass above said end warp, is positioned downstream in the rotation direction of said loop brush roller.

7. An image forming apparatus comprising:

an image carrier; and a loop brush roller arranged in rotatable contact with said image carrier, and including a core roller and a ribbon brush spirally wound around said core roller, wherein said ribbon brush includes:

a base member formed by weaving warps extending in the same direction as a weaving direction and wefts extending perpendicularly to said weaving direction together, and fiber bundles extending in said base member and between said warps in parallel with said warp;

said fiber bundle forms loops protruding beyond a surface side of said base member with constant spaces therebetween;

opposite ends located in a direction perpendicular to the weaving direction each has an end fiber bundle and an end warp, the end warp disposed on a side of the end fiber bundle facing a respective one of the opposite ends; and in at least one of the opposite ends, when said surface side is assumed as an upper side, said wefts extending between each pair of neighboring ones of said loops of the end fiber bundle pass under said end warp, and the wefts extending through each of the loops of the end fiber bundle passes above said warp.

8. The image forming apparatus according to claim 7, wherein said loop brush roller is configured such that, in at least one end of said ribbon brush located downstream with respect to the rotation direction of said loop brush roller, said weft extending between said neighboring loops passes under said warp, and the weft extending through said loop passes above said warp.

9. The image forming apparatus according to claim 7, wherein said image forming apparatus includes a solid lubricant, and said solid lubricant is pressed against said loop brush roller.

10. The image forming apparatus according to claim 7, wherein in each of the opposite ends located in the direction perpendicular to the weaving direction of said ribbon brush, said weft extending between said neighboring loops passes under said warp, and the weft extending through said loop passes above said end warp.

11. The image forming apparatus according to claim 1, wherein said warps between said fiber bundles are even in number, and said fiber bundles are even in number.

12. The image forming apparatus according to claim 7, wherein said warps between said fiber bundles are even in number, said fiber bundles are odd in number, and said ribbon brush is spirally wound around said core roller such that one end of the opposite ends located in the direction perpendicular to said weaving direction of said ribbon brush, where said weft extending between said neighboring ones of said loops pass under said end warp and the weft extending through said loop pass above said warp, is positioned downstream in the rotation direction of said loop brush roller.

13. The image forming apparatus according to claim 7, wherein said warp(s) between said fiber bundles are odd in number, said fiber bundles are, odd in number, and said ribbon brush is spirally wound around said core roller such that one end of the opposite ends located in the direction perpendicular to said weaving direction of said ribbon brush, where said weft extending between said neighboring ones of said loops pass under said end warp and the weft extending through said loop pass above said end warp, is positioned downstream in the rotation direction of said loop brush roller.

* * * * *